United States Patent [19]

Floyd

[11] 4,447,038

[45] May 8, 1984

[54] BLOW-OUT PROTECTOR PACKER ELEMENT

[75] Inventor: Raymond C. Floyd, Spring, Tex.

[73] Assignee: The Mead Corporation, Dayton, Ohio

[21] Appl. No.: 350,455

[22] Filed: Feb. 19, 1982

[51] Int. Cl.[3] ..... E21B 33/06

[52] U.S. Cl. ..... 251/1 B; 251/1 A; 277/233; 277/235 R

[58] Field of Search ..... 251/1 A, 1 B, 1 R; 277/233, 235 R, DIG. 6

[56] References Cited

U.S. PATENT DOCUMENTS

| | | | |
|---|---|---|---|
| 1,963,683 | 6/1934 | Schaffer . | |
| 2,139,526 | 12/1938 | Snell . | |
| 2,231,221 | 2/1941 | Rector . | |
| 2,375,432 | 5/1945 | Miller et al. . | |
| 2,846,178 | 8/1958 | Minor | 251/1 B |
| 3,102,709 | 9/1963 | Allen | 251/1 A |
| 3,837,657 | 9/1974 | Farnam et al. . | |
| 4,317,575 | 3/1982 | Cavicchio | 277/DIG. 6 |

FOREIGN PATENT DOCUMENTS

| | | | |
|---|---|---|---|
| 839339 | 6/1960 | United Kingdom | 251/1 A |

*Primary Examiner*—Martin P. Schwadron
*Assistant Examiner*—Sheri Novack
*Attorney, Agent, or Firm*—Biebel, French & Nauman

[57] ABSTRACT

A packer element for a blow-out protector comprising a body of an elastomeric packing material interposed between a pair of opposed reinforcing plates wherein a slight pre-load compression is imparted to the working surface with which the packer element seals off the annular space around a drill pipe. The pre-load compression is achieved by forming the packing body with top and bottom surfaces which diverge in the direction of the working surface and compressing the packing body between the reinforcing plates such that in the blow-out protector the reinforcing plates sit in substantially planar parallel relation. By building pre-load compression into the packer element, it has been found that the useful life of the element is enhanced.

10 Claims, 5 Drawing Figures

BLOW-OUT PROTECTOR PACKER ELEMENT

BACKGROUND OF THE INVENTION

The present invention relates to a ram-type packer element for use in a blow-out protector and, more particularly, to a packer element which is designed to be useful as a stripping tool and provide good shear-resisting properties.

Blow-out protectors are well known. In general, they are valve devices which are designed to pack off the annular space between the drill pipe and the well casing in the event of a blow-out. A typical blow-out protector comprises, as its essential components, a packing element and an exteriorly operated actuator means which acts on the packing element and forces it into sealing engagement with the drill pipe. Usually, the blow-out protector includes or is associated with some means of sensing or reacting to an increase of pressure in the well hole and is designed such that the protector is actuated and the well pressure is controlled before the well pressure can do substantial damage to the drilling equipment or cause injury at the drilling site.

One example of a blow-out protector is illustrated in U.S. Pat. No. 2,231,221. In that protector, the packing element is carried on an elongated actuator sleeve provided with a plurality of annular gear teeth. In the event of a blow-out, the packing element is driven by the sleeve into abutment with a shoulder located internally in the well hole whereupon the packing element is compressed and the packing extrudes or bulges from the element and into sealing engagement with the drill pipe. There are numerous other examples of blow-out protectors in the art which differ in the design of the packing element and the means whereby the element is forced into sealing engagement with the drill pipe. A few examples of the other drill pipe protectors that have been known are disclosed in U.S. Pat. Nos. 2,375,432; 2,139,526; and 1,963,683.

A frequent design used for the packing element, or "gate" as it is sometimes referred, is a generally semi-circular structure in which an elastomeric packing is interposed between two semi-circular reinforcing elements. The structure is formed with a semi-cylindrical cut out or arch in its diametric side which receives the drill pipe. The packing which faces on this cut out defines a work surface which packs off the well casing. The elastomeric packing is usually a block of a high strength wear-resistant rubber compound. Packing elements are used in pairs with one element positioned diametrically opposite the other on each side of the drill pipe such that the drill pipe extends through the circular aperture formed by the interfacing semi-cylindrical arches. In the blow-out protector, the elements function as a packer valve. Pressure is applied to each element of the pair whereby the element is compressed or deformed and the packing extrudes from the element and engages the drill pipe to seal off the annular space around the pipe in the well.

One problem which blow-out protector packer elements have faced is a tendency for the elements to wear out and fail in use. A major source of wear occurs when the drill pipe is pulled out of the well to replace damaged pipe or a worn drill bit. As the drill pipe is withdrawn from of the well, it is coated with the drilling fluids which carry suspended bits of cut rock and the like. As the surface of the pipe slides across the packing element in the blow-out protector, the packing element is subjected to elongational shear along the working face. This forceably elongates the working surface and gradually mechanically degrades the packing element to the point that it can no longer function satisfactorily. One practice that is frequently adopted which intensifies abrasion and wear is to partially close the blow-out protector as the drill pipe is removed from the well in order to use the packing element as a stripping tool to remove mud and drilling fluids from the drill pipe surface. This operation prevents even greater abrasion and wear problems since the packing element is positively biased against the surface of the drill pipe as it is removed. Under the applied pressure of the blow-out protector, the packing element is subjected to higher shearing forces which enhances mechanical degradation. As the packing element is worn and degraded it becomes unable to deliver a uniform sealing action around the circumference of the drill pipe in the event of a blow-out.

Several attempts have previously been made to overcome the wear-resistance and abrasion-resistance problems and to improve the useful service life of blow-out protector packing elements. Efforts have particularly concentrated on developing elastomeric compositions and elastomeric composites which resist the wear and abrasion caused by the drill pipe. Relatively little attention has been directed to the packing element design itself.

SUMMARY OF THE INVENTION

A principal object of the present invention is to provide a blow-out protector packing element having improved abrasion and wear resistance.

Another object of the present invention is to provide a packing element which can be used as a stripping tool to remove mud and drilling fluids from the surface of the drill pipe as it is withdrawn from the well without impairing the ability of the packing element to seal off the well in the event of a blow-out.

Still another object of the invention is to provide a packing element which neutralizes or reduces the surface elongational mechanical degradation which occurs when a drill pipe slides across the working surface of the packing element.

These and other objects of the present invention are attained by a blow-out protector packing element in which a body of elastomeric packing material is maintained under a slight localized, pre-load compression in the vicinity of the work surface with which the packing element grips the drill pipe in the event of a blow-out or when used as a stripper tool. The term "pre-load compression" as used herein designates an in situ compression which is built into the packing element by dimensioning the packing element larger along its work surface and compressing it between a pair of reinforcing plates as described below. In accordance with the present invention, it has been found that elongational shear of the working surface caused by the drill pipe as it slides across the work surface is at least partially neutralized or compensated by pre-compressing the elastomeric packing. The pre-load compression built into the invention packing element offsets the initial shearing caused when the drill pipe slides along the work surface of the packing. Thus, the invention element may be considered as having a built-in reserve of compression which is gradually exhausted as the element is used as a stripper tool but which extends its useful service life. It has been found that the invention element is degraded less by the precompression-elongation cycle than by the compression-relaxation cycle which occurs with conventional elements. Thus, the packing elements of the present invention have a longer useful life and can be used to strip drill mud from the drill pipe as it is removed from the well.

In accordance with the present invention, a pre-load compression is built into the packing element by molding the elastomeric body with top and bottom surfaces which diverge in the direction of the working surface. In the completely uncompressed element, the reinforcing plates which bracket the elastomeric body are offset approximately 1° to 10° preferably 2° to 7° and in the most typical case about 5°. (The angle between one plate and and a horizontal line when the other plate is horizontal.) By applying a clamping pressure to the offset reinforcing plates the plates are drawn into a substantially planar parallel relation and the work surface is maintained under a slight pre-load compression.

Clamping pressure can be applied to the packing element by various means of which probably the simplest to effect is to tie the plates with a tie bolt which is counter-sunk in one of the plates and extends through a channel in the elastomeric body to a threaded hole in the other plate. Of course, the tie bolts can be replaced by functionally equivalent fastening means. Another means of imparting pre-load compression is to provide mounting means for the packing element in the blow-out protector in which converging cam surfaces are appropriately positioned relative to the divergence in the packing element such that in receiving the packing element the reinforcing plates are forced into a parallel relation.

For purposes of the discussion herein, pre-loaded compression is described with reference to the planar parallel relationship of the reinforcing plates, however, those skilled in the art will appreciate that pre-loaded compression can be achieved when the plates are not perfectly parallel; accordingly, the reinforcing plates in the pre-compressed element are sometimes described herein as being in "substantially planar parallel relation".

The angle of offset between the reinforcing plates in an uncompressed element in accordance with the invention may vary from approximately 1° to 10° with 5° offset being representative. Theoretically, some benefit is achieved in the invention with even the slightest compression of the working surface. Hence, offsets greater than 0° can be used in the invention. As a practical matter, the improvement in wear resistance is not appreciable until the plates are offset 1° to 2°. In terms of the change in the thickness of the working surface side of the packing element, pre-load compression may range from approximately 2.5% to 5.0% when calculated as the percent difference between the width of the working surface side of the packing element in the pre-compressed and the uncompressed state based on the final pre-compressed width. Again, however, some improvement in wear resistance is achieved at percent compressions less than 2.5%.

Packing elements fabricated in accordance with the present invention can be used in conjunction with various blow-out protector devices; the present invention does not reside in the particular blow-out protector device used. Generally, the invention element can be used in conjunction with any blow-out protector in which the blow-out protector is closed by applying pressure to the work surface through parallel opposed major surfaces of the packing element. The packing element of the invention can be used in conjunction with blow-out protectors, such as those illustrated in U.S. Pat. Nos. 2,139,526 and 2,231,221.

DETAILED DESCRIPTION OF A WORKING EMBODIMENT

Figure 1:
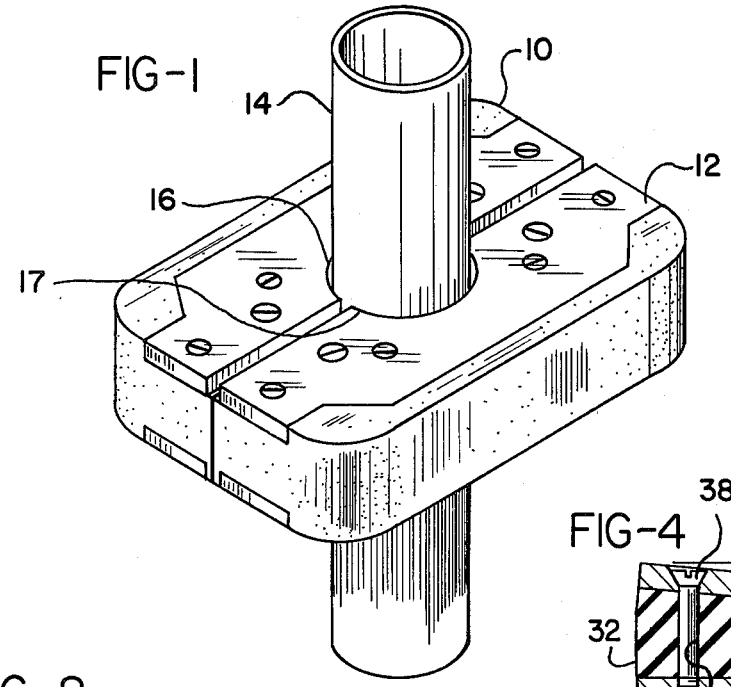
FIG. 1 is a perspective view of a pair of opposed packing elements in accordance with the invention showing their orientation with respect to a drill pipe.

FIG. 1 illustrates the orientation of the packing elements of the present invention with respect to the drill pipe. In FIG. 1, packing elements 10 and 12 are opposed about the drill pipe 14 such that the semi-cylindrical arches 16 and 17 form a cylindrical channel through which the drill pipe 14 extends. FIG. 1 is only for illustration, in actuality packing elements 10 and 12 would be mounted in a blow-out protector device capable of applying a pressure to the opposed major surfaces of the element in the event of a blow-out or when using the element as a stripping tool. In both events, pressure on the packing elements causes the elastomer to extrude around the drill pipe 14 and close off the space between the pipe and the packing elements.

Figure 2:
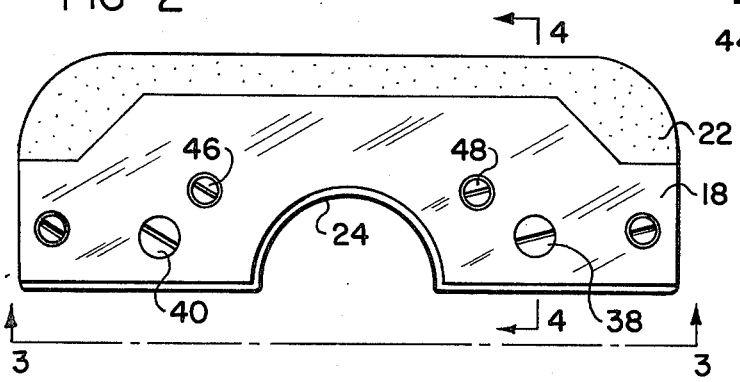
FIG. 2 is a top plan view of one of the elements shown in FIG. 1.
Figure 3:
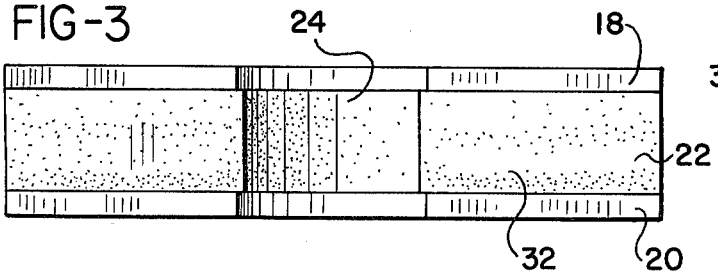
FIG. 3 is a side elevation view of the same element.

Referring to FIGS. 2 and 3, the packing element of the present invention comprises a pair of horizontally oriented reinforcing plates 18 and 20 respectively positioned on the top and bottom of an elastomeric body or block 22.

Various commercially available elastomers can be used in forming the elastomeric body 22. Elastomeric compounds which exhibit high wear and abrasion resistance are preferred. One technique frequently used to improve the wear resistance of the elastomer is to incorporate into the elastomer a fibrous and/or particulate reinforcing material such as fiber glass, nylon fiber, carbon black, etc. One composition that has been used effectively is shown below.

| | Parts |
|---|---|
| HYCAR 1000 × 225 (acrylonitrile-butadien rubber 41% ACN) | 100.0 |
| Zinc oxide | 5.0 |
| Stearic acid | 1.0 |
| SRF N-762 (carbon black) | 56.0 |
| Sulfur | 0.1 |
| VULTROL (REDAX)(N—Nitroso diphenyl amine) | 1.0 |
| Ethyl tuads (tetraethyl thiuram disulfide) | 2.5 |
| Hycor 505 glass (PPG fiberglass ¼ inch chopped strand) | 20.0 |

The external shape of the packing element is designed to accomodate the particular blow-out protector with which the elements are employed. In the embodiment illustrated, plates 18 and 20 and elastomeric body 22 have a generally rectangular layout in which the corners are truncated. For some types of blow-out protector, the packing elements must be semi-cylindrical. The reinforcing plates may extend commensurate with the surface of the elastomeric block, however, it is generally preferred to inset the plates a small distance (about ½") on the back side. On the other hand, the plates are preferably co-extensive with the rubber around the arch 24 so as to direct the extrusion of the rubber against the drill pipe when the element is under compression.

The packing element is formed with a semi-cylindrical arch 24 which is centrally located on one of its major sides. Arch 24 is defined by corresponding aligned semi-circular cut outs in the reinforcing plates 18 and 20 and the elastomeric body 22. The cut-outs are sized to have a radius of curvature larger than that of the drill pipe such that by applying pressure to the plates the space around the drill pipe is sealed off. Arch 24 defines a working surface 26 which grips the drill pipe 14 when the packing element is under the exteriorly applied pressure of the blow-out protector.

Figure 4:
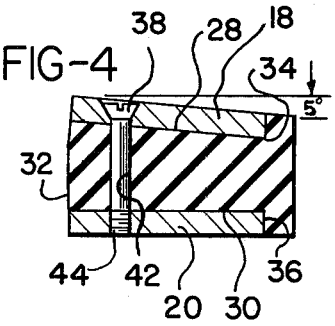
FIG. 4 is a sectional side view through the line 4—4 in FIG. 2 showing the state of the elastomeric body when the packing element is uncompressed.

The elastomeric body 22 is best seen in FIG. 4 where it is shown in an uncompressed state. Body 22 is formed with top and bottom surfaces 28 and 30 which diverge toward the working surface side 32 of the packing element. When placed on the elastomeric body, plates 18 and 20 abutt shoulders 34 and 36 respectively positioned at the back side of the upper and lower surfaces of the packing element. Elastomeric body 22 is dimensioned such that plates 18 and 20 are offset 5° from horizontal in the embodiment illustrated.

Figure 5:
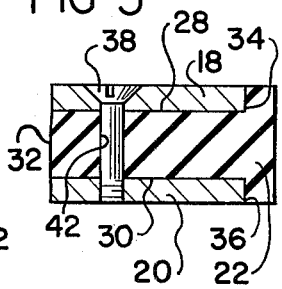
FIG. 5 is a sectional side view as in FIG. 3 showing the state of the elastomeric body under pre-load compression.

In the embodiment which has been illustrated, a pre-load compression is applied to the working side of the packing element by tieing plates 18 and 20 with countersunk tie bolts 38 and 40. Two or more bolts are appropriately located in the packing element to provide uniform compression along the working surface side 32 of the element as described next. Tie bolt 40 extends through a bore 42 in the elastomeric body and screws into a threaded hole 44 in the base plate 20 as seen in FIGS. 4 and 5. A similar arrangement is provided on the opposite side of the packing element for the tie bolt 38. Pre-load compression is applied to the packing element by tightening the bolts 38 and 40. Pivot bolts 46 and 48 are provided in the element displaced slightly rearward of bolts 38 and 40 so that as bolts 38 and 40 are tightened, plates 18 and 20 pivot about pivot bolts 46 and 48 and assume a planar parallel relationship as shown in FIG. 5. This has the effect of building in compression on the working surface side 32 of the packing element.

Having described the invention in detail and with reference to a specific embodiment thereof, those skilled in the art will appreciate that numerous modifications and variations therein are possible without departing from the invention defined by the following claims:

I claim:

1. A packing element for a blow-out protector comprising:

a first reinforcing plate, a second reinforcing plate, a body of an elastomer interposed between said reinforcing plates, said plates and said body being formed with semi-cylindrical cutouts on one side thereof which are aligned in said element, a semi-cylindrical arch formed by said aligned cutouts, said elastomer facing on said arch being compressed and defining a work surface, said elastomeric body having upper and lower surfaces respectively interfacing said reinforcing plates, the thickness of said body being greater along said work surface than in the balance of said body such that said surfaces diverge in the direction of said work surface when said body is in a free and uncompressed condition, and means for holding said reinforcing plates in parallel relationship and thereby compressing said elastomeric body at said work surface such that a preload compression is built into said work surface.

2. The packing element of claim 1 wherein said means for holding said plates in parallel relationship comprises a system of tie bolts extending through said body and drawing said upper and lower plates together such that a clamping pressure is applied to said body in the area of said work surface.

3. The packing element of claim 1 wherein said elastomeric body comprises an abrasion-resistant rubber compound.

4. The packing element of claim 1 wherein said elatomeric body is reinforced with carbon black.

5. The packing element of claim 1 wherein said surfaces and plates diverge up to 10° when said elastomeric body is uncompressed.

6. In a blow-out protector comprising a pair of interfacing ram packer elements housing a body of an elastomer and exterior means for applying pressure to said elements such that said elastomer is extruded from said element and closes off the space around a drill pipe, the improvement wherein said packer element comprises:

a first reinforcing plate, a second reinforcing plate, a body of an elastomer interposed between said reinforcing plates, said plates and said body being formed with semi-cylindrical cutouts on one side thereof which are aligned in said element, a semi-cylindrical arch formed by said aligned cutouts, said elastomer facing on said arch being compressed and defining a work surface, said elastomeric body having upper and lower surfaces respectively interfacing said reinforcing plates, the thickness of said body being greater along said work surface than in the balance of said body such that said surfaces diverge in the direction of said work surface when said body is in a free and uncompressed condition, and means for holding said reinforcing plates in parallel relationship and thereby compressing said elastomeric body at said work surface such that a preload compression is built into said work surface.

7. The blow-out protector of claim 6 wherein said means for holding said reinforcing plates in parallel relationship comprises a system of tie bolts extending through said body and drawing said upper and lower plates together such that a clamping pressure is applied to said body in the area of said work surface.

8. The blow-out protector of claim 6 wherein said elastomeric body comprises an abrasion resistant rubber compound.

9. The blow-out protector of claim 6 wherein said protector comprises cam surfaces appropriately positioned to compress said plates and draw them into substantially planar relation.

10. The blow-out protector of claim 7 wherein said surfaces and plates diverge up to 10° when said elastomeric body is uncompressed.

* * * * *

UNITED STATES PATENT OFFICE

CERTIFICATE OF CORRECTION

Patent No. 4,447,038 Dated May 8, 1984

Inventor(s) Raymond C. Floyd

It is certified that error appears in the above-identified patent and that said Letters Patent are hereby corrected as shown below:

Column 2, line 10, "prevents" should be --presents--.

Column 3, line 28, "of" should be --for--.

Claim 10, line 1, "7" should be --6--.

Signed and Sealed this

*Eighteenth* Day of *December 1984*

[SEAL]

*Attest:*

*Attesting Officer*

GERALD J. MOSSINGHOFF

*Commissioner of Patents and Trademarks*